US010550342B2

(12) United States Patent
Salazar-Guillen et al.

(10) Patent No.: US 10,550,342 B2
(45) Date of Patent: Feb. 4, 2020

(54) INTEGRATED PROCESS FOR INCREASING OLEFIN PRODUCTION BY RECYCLING AND PROCESSING HEAVY CRACKER RESIDUE

(71) Applicant: SABIC GLOBAL TECHNOLOGIES B.V., Bergen op Zoom (NL)

(72) Inventors: Jose Armando Salazar-Guillen, Sugar Land, TX (US); Michael Huckman, Sugar Land, TX (US); Scott Stevenson, Sugar Land, TX (US)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/079,422

(22) PCT Filed: Jan. 31, 2017

(86) PCT No.: PCT/US2017/015733

§ 371 (c)(1),
(2) Date: Aug. 23, 2018

(87) PCT Pub. No.: WO2017/146876

PCT Pub. Date: Aug. 31, 2017

(65) Prior Publication Data

US 2019/0055482 A1 Feb. 21, 2019

Related U.S. Application Data

(60) Provisional application No. 62/299,714, filed on Feb. 25, 2016.

(51) Int. Cl.
*C10G 67/04* (2006.01)

(52) U.S. Cl.
CPC ..... *C10G 67/049* (2013.01); *C10G 67/0481* (2013.01); *C10G 2300/1077* (2013.01);
(Continued)

(58) Field of Classification Search
None
See application file for complete search history.

(56) References Cited

U.S. PATENT DOCUMENTS 5,286,371 A * 2/1994 Goval ..... C10G 69/00 208/131
6,149,800 A 11/2000 Iaccino et al.
(Continued)

FOREIGN PATENT DOCUMENTS

CA 2880515 2/2014
CN 101418222 4/2004
(Continued)

OTHER PUBLICATIONS

International Search Report and Written Opinion issued in International Patent Application No. PCT/US2017/015733, dated Apr. 10, 2017.
(Continued)

*Primary Examiner* — Tam M Nguyen
(74) *Attorney, Agent, or Firm* — Norton Rose Fulbright US LLP

(57) ABSTRACT

An integrated process for increasing olefin production is described through which heavy cracker residues of fluid catalytic cracking unit and steam cracking unit are completely mixed, and mixed stream is properly recycled and further combined with atmospheric tower bottoms. Combined stream is deasphalted and hydrotreated to produce a proper feedstock for steam cracking unit for manufacturing light olefin compounds. The integrated process produces higher amount of light olefins than a substantially similar process without processing the heavy cracker residues.

20 Claims, 3 Drawing Sheets

(52) U.S. Cl.
CPC . *C10G 2300/4081* (2013.01); *C10G 2400/20* (2013.01); *C10G 2400/30* (2013.01)

(56) References Cited

U.S. PATENT DOCUMENTS

| | | | | |
|---|---|---|---|---|
| 6,153,087 | A | 11/2000 | Bigeard et al. | |
| 6,270,654 | B1 | 8/2001 | Colyar et al. | |
| 7,214,308 | B2 | 5/2007 | Colyar | |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,840,674 | B2 | 12/2017 | Weiss et al. | |
| 2007/0163921 | A1 | 7/2007 | Keusenkothen et al. | |
| 2008/0083649 | A1 | 4/2008 | McCoy et al. | |
| 2008/0093260 | A1 | 4/2008 | Koseoglu | |
| 2008/0093262 | A1 | 4/2008 | Gragnani et al. | |
| 2008/0099379 | A1* | 5/2008 | Ramamurthy | C10G 9/28 208/390 |
| 2009/0194458 | A1 | 8/2009 | Ou et al. | |
| 2009/0308788 | A1* | 12/2009 | Lenglet | C10G 45/14 208/57 |
| 2009/0314681 | A1* | 12/2009 | Marchionna | C10G 67/049 208/57 |
| 2011/0207979 | A1 | 8/2011 | Kim et al. | |
| 2012/0031811 | A1 | 2/2012 | Cowan et al. | |
| 2012/0270957 | A1* | 10/2012 | Kresnyak | C10G 2/30 518/704 |
| 2013/0081976 | A1* | 4/2013 | Heraud | C10G 49/12 208/49 |
| 2013/0220884 | A1 | 8/2013 | Bourane et al. | |
| 2013/0233768 | A1 | 9/2013 | Bourane et al. | |
| 2013/0267745 | A1 | 10/2013 | Schrod et al. | |
| 2014/0061094 | A1 | 3/2014 | Xu et al. | |
| 2014/0061100 | A1 | 3/2014 | Lattner et al. | |
| 2014/0299515 | A1 | 10/2014 | Weiss et al. | |
| 2015/0004062 | A1 | 1/2015 | Freel et al. | |
| 2015/0021234 | A1 | 1/2015 | Merdrignac et al. | |
| 2015/0038599 | A1* | 2/2015 | Kresnyak | C01B 21/087 518/702 |
| 2016/0122666 | A1 | 5/2016 | Weiss et al. | |
| 2018/0155643 | A1* | 6/2018 | Al-Ghamdi | C10G 69/08 |
| 2018/0291288 | A1* | 10/2018 | Brown | C10G 55/06 |

FOREIGN PATENT DOCUMENTS

| | | |
|---|---|---|
| IN | 201300088 | 6/2013 |
| WO | WO 99/19424 | 4/1999 |
| WO | WO 2016/146326 | 9/2016 |

OTHER PUBLICATIONS

Guo et al., "Separation of Toluene-Insoluble Solids in the Slurry Oil from a Residual Fluidized Catalytic Cracking unit: Determination of the Solid Content and Sequential Selective Separation of Solid Components" *Energy Fuels*, 2014, 28:3053-3065.

Özkan et al., "Catalytic Upgrading of Off-Spec Aromatic-Rich Oils from the NSC Process" *Energy & Fuels*, 13:433-439.

* cited by examiner

INTEGRATED PROCESS FOR INCREASING OLEFIN PRODUCTION BY RECYCLING AND PROCESSING HEAVY CRACKER RESIDUE

CROSS REFERENCE TO RELATED APPLICATIONS

This application is a filing under 35 U.S.C. 371 of International Application No. PCT/US2017/015733 filed Jan. 31, 2017, entitled, "An Integrated Process for Increasing Olefin Production by Recycling and Processing Heavy Cracker Residue," which claims the benefit of U.S. Provisional Application No. 62/299,714 filed Feb. 25, 2016, entitled "An Integrated Process for Increasing Olefin Production by Recycling and Processing Heavy Cracker Residue," which are incorporated by referenced herein in their entirety.

TECHNICAL FIELD

The present invention relates to an integrated process for increasing olefin production by processing the bottom residues of one or more cracking units to prepare a suitable feedstock for steam cracking and increased olefin production.

BACKGROUND OF THE INVENTION

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Steam cracking and residue fluid catalytic cracking are widely used to crack different crude oil fractions into olefins, preferably ethylene, propylene, butylene and naphtha. However byproducts such as pyrolysis oil, coke and clarified slurry oil may also be produced in these processes. Accordingly, several methods have been proposed in the prior art for upgrading these low value streams. For instance, US patent No. US20130233768A1 describes an integrated solvent deasphalting, hydrotreating and steam pyrolysis process for direct processing of a crude oil to produce petrochemicals, wherein pyrolysis oil is recovered as fuel oil. US patent No. US20080083649A1 describes a method by which a pyrolysis oil stream was delivered to a vacuum pipestill to obtain a deasphalted cut of tar and an asphaltenic stream. The asphaltenic stream was further delivered to a coker or a partially oxidizing unit to produce light products such as coker naphtha, or coker gasoil, or syngas. The deasphalted material was further used as a fuel oil or mixed with locally combusted materials to lower soot make. US patent No. US200901944S8A1 describes a process and an apparatus for upgrading steam cracker tar. Accordingly, a heating process was proposed that reduced the yield of tar or pyrolysis oil in steam cracking process. It was further described that resulting heat treated tar can be separated into gasoil, fuel oil and tar streams. US patent No. US20140061100A1 describes a process to reduce asphaltene content in pyrolysis oil stream and to partially recover consumed thermal energy in pyrolysis process by quenching the pyrolysis oil stream. US patent No. US20070163921A1 discloses a method to improve solubility of steam cracked tar, followed by adding improved steam cracked tar to fuel oil. US patent No. US20140061094A1 relates to a hydrotreating process and a hydrotreated product that can be produced by the hydrotreating process of a pyrolysis oil stream, or pyrolysis tar. This hydrotreated product is further used as diluent for heavy fractions in fuel oil. However, hydrotreating process of pyrolysis oil or pyrolysis tar using conventional catalytic hydrotreatment units without removing asphaltene and coke precursors reduces catalyst life cycle due to rapid catalyst deactivation. US patent No. US20130267745A1 describes an integrated process to convert more than 60% of feedstock crude oil to proper feedstock for steam crackers and produced pyrolysis oil is used as feed to a coking unit.

In view of the forgoing, one objective of the present disclosure is to provide an integrated process for increasing olefin production by combining the bottom residues of one or more cracking units, and processing the bottom residues to prepare a suitable feedstock for steam cracking to form light olefins.

BRIEF SUMMARY OF THE INVENTION

According to a first aspect, the present disclosure relates to an integrated process for increasing olefin production by recycling and processing heavy cracker residue, involving i) hydrotreating atmospheric tower bottoms, which is supplied by an upstream atmospheric distillation column, with a first hydrotreater to form a first hydrotreated residue stream, ii) catalytically cracking the first hydrotreated residue stream in a fluid catalytic cracking unit to form a liquefied petroleum gas stream, a naphtha stream, a dry gas stream, a clarified slurry oil stream and a light cycle oil stream, iii) hydrotreating the naphtha stream in a second hydrotreater to form a hydrotreated naphtha stream, iv) hydrocracking the light cycle oil stream in a hydrocracker to form a cracked hydrocarbon stream, v) blending the hydrotreated naphtha stream and the cracked hydrocarbon stream to form an aromatic blended hydrocarbon stream, vi) saturating the aromatic blended hydrocarbon stream in an aromatic saturating unit to form a saturated hydrocarbon stream, vii) steam cracking the saturated hydrocarbon stream in a steam cracking unit to form a first olefin stream, a pyrolysis oil stream, and a pyrolysis gasoline stream, viii) mixing the clarified slurry oil stream and the pyrolysis oil stream to form a recycle oil stream, ix) deasphalting the recycle oil stream in a solvent deasphalting unit to form a deasphalted oil stream and an asphaltene rich stream, x) hydrotreating the deasphalted oil stream and the atmospheric tower bottoms with the first hydrotreater to form a second hydrotreated residue stream, xi) delivering the second hydrotreated residue stream to the fluid catalytic cracking unit and repeating the integrated process to form a second olefin stream.

In one embodiment, the integrated process further comprises combining the first olefin stream and the second olefin stream to give a final olefin yield that is higher than a substantially similar process without the mixing, the deasphalting, the hydrotreating the deasphalted oil stream and the atmospheric tower bottoms, and the delivering.

In one embodiment, the integrated process further comprises mixing the atmospheric tower bottoms with the recycle oil stream prior to the deasphalting.

In one embodiment, the integrated process further comprises collecting at least a portion of the asphaltene rich stream for processing into asphalt.

In one embodiment, the steam cracking forms hydrogen gas in addition to the first olefin stream, the pyrolysis oil stream, and the pyrolysis gasoline stream.

In one embodiment, the integrated process further comprises delivering at least a portion of the hydrogen gas to the first hydrotreater, the second hydrotreater, or both.

In one embodiment, the light cycle oil stream is saturated prior to the hydrocracking.

In one embodiment, the light cycle oil stream is hydrotreated prior to the hydrocracking.

In one embodiment, the integrated process further comprises removing particulates from the clarified slurry oil stream, the recycle oil stream, or both.

In one embodiment, the clarified slurry oil stream and the pyrolysis oil stream are mixed in the presence of a miscible organic solvent.

In one embodiment, the fluid catalytic cracking unit is a residue fluid catalytic cracking unit.

According to a second aspect, the present disclosure relates to an integrated process for increasing olefin production by recycling and processing heavy cracker residue, involving i) hydrotreating atmospheric tower bottoms with a first hydrotreater to form a first hydrotreated residue stream, ii) catalytically cracking the first hydrotreated residue stream in a fluid catalytic cracking unit to form a liquefied petroleum gas stream, a naphtha stream, a dry gas stream, a clarified slurry oil stream and a light cycle oil stream, iii) hydrotreating the naphtha stream in a second hydrotreater to form a hydrotreated naphtha stream, iv) hydrocracking the light cycle oil stream in a hydrocracker to form a cracked hydrocarbon stream, v) blending the hydrotreated naphtha stream and the cracked hydrocarbon stream to form an aromatic blended hydrocarbon stream, vi) saturating the aromatic blended hydrocarbon stream in an aromatic saturating unit to form a saturated hydrocarbon stream, vii) steam cracking the saturated hydrocarbon stream in a steam cracking unit to form a first olefin stream, a pyrolysis oil stream, and a pyrolysis gasoline stream, viii) mixing the clarified slurry oil stream and the pyrolysis oil stream to form a recycle oil stream, ix) deasphalting the recycle oil stream in a solvent deasphalting unit to form a deasphalted oil stream and an asphaltene rich stream, x) coking at least a portion of the asphaltene rich stream to form a light hydrocarbon stream, xi) steam cracking the light hydrocarbon stream to form a third olefin stream, xii) hydrotreating the deasphalted oil stream and the atmospheric tower bottoms with the first hydrotreater to form a second hydrotreated residue stream, xiii) delivering the second hydrotreated residue stream to the fluid catalytic cracking unit and repeating the integrated process to form a second olefin stream.

In one embodiment, the integrated process further comprises combining the first olefin stream, the second olefin stream, and the third olefin stream to give a final olefin yield that is higher than a substantially similar process without the mixing, the deasphalting, the coking, the steam cracking the light hydrocarbon stream, the hydrotreating the deasphalted oil stream and the atmospheric tower bottoms, and the delivering.

In one embodiment, the integrated process further comprises mixing the atmospheric tower bottoms with the recycle oil stream prior to the deasphalting.

In one embodiment, the integrated process further comprises removing particulates from the clarified slurry oil stream, the recycle oil stream, or both.

According to a third aspect, the present disclosure relates to an integrated process for increasing olefin production by recycling and processing heavy cracker residue, involving i) hydrotreating atmospheric tower bottoms with a first hydrotreater to form a first hydrotreated residue stream, ii) catalytically cracking the first hydrotreated residue stream in a fluid catalytic cracking unit to form a liquefied petroleum gas stream, a naphtha stream, a dry gas stream, a clarified slurry oil stream and a light cycle oil stream, iii) hydrotreating the naphtha stream in a second hydrotreater to form a hydrotreated naphtha stream, iv) hydrocracking the light cycle oil stream in a hydrocracker to form a cracked hydrocarbon stream, v) blending the hydrotreated naphtha stream and the cracked hydrocarbon stream to form an aromatic blended hydrocarbon stream, vi) saturating the aromatic blended hydrocarbon stream in an aromatic saturating unit to form a saturated hydrocarbon stream, vii) steam cracking the saturated hydrocarbon stream in a steam cracking unit to form a first olefin stream, a pyrolysis oil stream, and a pyrolysis gasoline stream, viii) mixing the clarified slurry oil stream and the pyrolysis oil stream to form a recycle oil stream, ix) deasphalting the recycle oil stream in a solvent deasphalting unit to form a deasphalted oil stream and an asphaltene rich stream, x) partially oxidizing at least a portion of the asphaltene rich stream to produce a synthesis gas stream, xi) hydrotreating the deasphalted oil stream and the atmospheric tower bottoms with the first hydrotreater to form a second hydrotreated residue stream, xii) delivering the second hydrotreated residue stream to the fluid catalytic cracking unit and repeating the integrated process to form a second olefin stream.

In one embodiment, the synthesis gas stream comprises hydrogen gas and the process further comprises separating at least a portion of the hydrogen gas from the synthesis gas stream and delivering it to the first hydrotreater, the second hydrotreater, or both.

In one embodiment, the integrated process further comprises delivering at least a portion of the synthesis gas stream to a reforming unit for manufacturing oxo-aldehydes, or oxo-alcohols.

In one embodiment, the integrated process further comprises mixing the atmospheric tower bottoms with the recycle oil stream prior to the deasphalting.

In one embodiment, the integrated process further comprises removing particulates from the clarified slurry oil stream, the recycle oil stream, or both.

According to a fourth aspect, the present disclosure relates to an integrated process for forming an olefin stream from heavy cracker residues, involving i) catalytically cracking a first hydrocarbon mixture to form a first clarified slurry oil stream, ii) steam cracking a second hydrocarbon mixture to form a first pyrolysis oil stream, iii) solvent deasphalting a combined oil stream comprising at least a portion of the first clarified slurry oil stream and at least a portion of the first pyrolysis oil stream to form a deasphalted stream and an asphaltene rich stream, iv) hydrotreating the deasphalted oil stream to form a hydrotreated stream, v) catalytically cracking the hydrotreated stream to form a propylene rich liquefied petroleum gas (LPG) stream, a naphtha stream, a dry gas stream, a second clarified slurry oil stream and a light cycle oil stream, vi) hydrotreating the naphtha stream to form a hydrotreated naphtha stream, vii) hydrocracking the light cycle oil stream to form a hydrocracked light cycle oil stream, viii) blending the hydrocracked light cycle oil stream and the hydrotreated naphtha stream to form an aromatics rich blended oil stream, ix) saturating the aromatics rich blended oil stream to form a saturates rich oil stream, x) steam cracking the saturates rich oil stream to form a second pyrolysis oil stream, an olefin stream, and a pyrolysis gasoline stream, xi) combining the second clarified slurry oil stream and the second pyrolysis oil stream to form a recycle oil stream.

According to a fifth aspect, the present disclosure relates to An integrated process for forming an olefin stream from heavy cracker residues, involving i) catalytically cracking a first hydrocarbon mixture to form a first clarified slurry oil stream, ii) steam cracking a second hydrocarbon mixture to form a first pyrolysis oil stream, iii) solvent deasphalting a combined oil stream comprising at least a portion of the first clarified slurry oil stream and at least a portion of the first pyrolysis oil stream to form a deasphalted stream and an asphaltene rich stream, iv) hydrotreating the deasphalted oil stream to form a hydrotreated stream, v) coking at least a portion of the asphaltene rich stream to form a light materials stream, vi) steam cracking the light materials stream to form a first olefin stream, vii) catalytically cracking the hydrotreated stream to form a propylene rich liquefied petroleum gas (LPG) stream, a naphtha stream, a dry gas stream, a second clarified slurry oil stream and a light cycle oil stream, viii) hydrotreating the naphtha stream to form a hydrotreated naphtha stream, ix) hydrocracking the light cycle oil stream to form a hydrocracked light cycle oil stream, x) blending the hydrocracked light cycle oil stream and the hydrotreated naphtha stream to form an aromatics rich blended oil stream, xi) saturating the aromatics rich blended oil stream to form a saturates rich oil stream, xii) steam cracking the saturates rich oil stream to form a second pyrolysis oil stream, a second olefin stream, and a pyrolysis gasoline stream, xiii) combining the second clarified slurry oil stream and the second pyrolysis oil stream to form a recycle oil stream.

According to a sixth aspect, the present disclosure relates to An integrated process for forming an olefin stream from heavy cracker residues, involving i) catalytically cracking a first hydrocarbon mixture to form a first clarified slurry oil stream, ii) steam cracking a second hydrocarbon mixture to form a first pyrolysis oil stream, iii) solvent deasphalting a combined oil stream comprising at least a portion of the first clarified slurry oil stream and at least a portion of the first pyrolysis oil stream to form a deasphalted stream and an asphaltene rich stream, iv) hydrotreating the deasphalted oil stream to form a hydrotreated stream, v) partially oxidizing at least a portion of the asphaltene rich stream to produce a synthesis gas stream, vi) catalytically cracking the hydrotreated stream to form a propylene rich liquefied petroleum gas (LPG) stream, a naphtha stream, a dry gas, a second clarified slurry oil stream and a light cycle oil stream, vii) hydrotreating the naphtha stream to form a hydrotreated naphtha stream, viii) hydrocracking the light cycle oil stream to form a hydrocracked light cycle oil stream, ix) blending the hydrocracked light cycle oil stream and the hydrotreated naphtha stream to form an aromatics rich blended oil stream, x) saturating the aromatics rich blended oil stream to form a saturates rich oil stream, xi) steam cracking the aromatically saturated stream to form a second pyrolysis oil stream, a second olefin stream, and a pyrolysis gasoline stream, xii) combining the second clarified slurry oil stream and the second pyrolysis oil stream to form a recycle oil stream.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
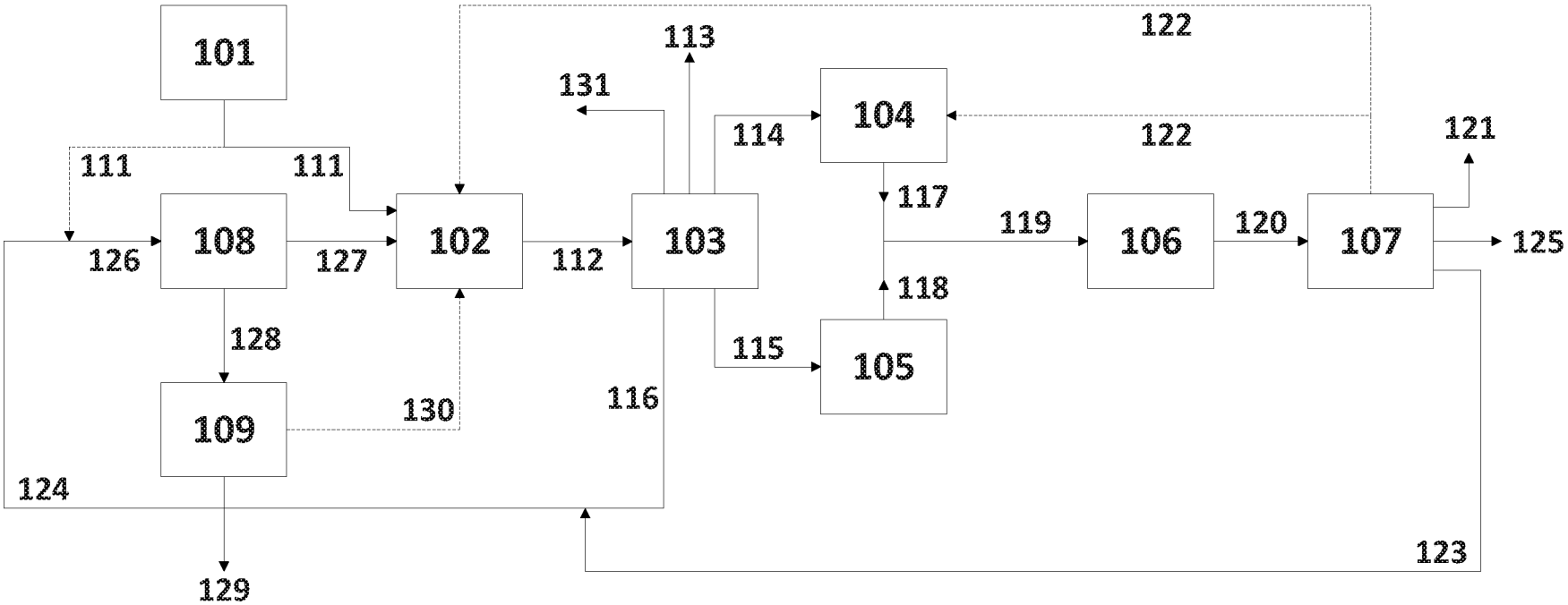
FIG. 1 is a Block Flow Diagram (BFD) that shows an overview of the integrated process for producing olefin by processing heavy cracker residue. (Dashed lines are supplemental streams that are not claimed to be part of the integrated process as in claim 1.)

Referring now to the drawings, wherein like reference numerals designate identical or corresponding parts throughout the several views.

Figure 2:
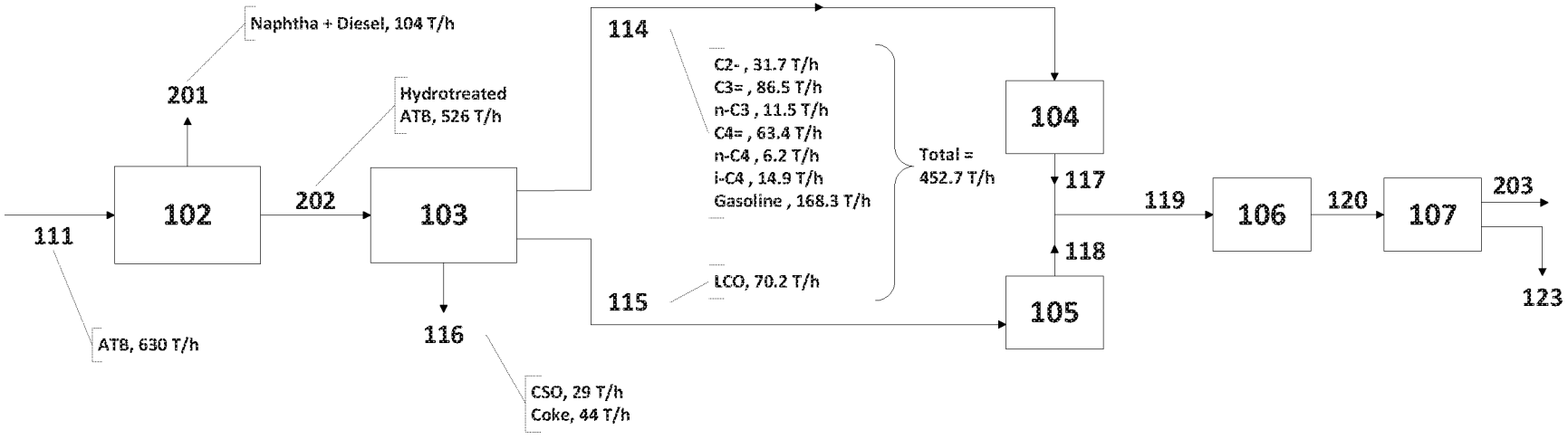
FIG. 2 is a Block Flow Diagram (BFD) that shows the conventional processing steps to produce light olefins from the atmospheric tower bottoms.

Referring now to FIG. 1 and FIG. 2. According to a first aspect, the present disclosure relates to an integrated process for increasing olefin production from heavy cracker residues, involving hydrotreating a heavy hydrocarbon residue stream 111 (e.g. an atmospheric tower bottoms (ATBs)), which is supplied by an upstream atmospheric distillation column 101, with a first hydrotreater 102 to form a first hydrotreated residue stream 202.

As used herein, the "heavy hydrocarbon residue stream" also refers to the "atmospheric tower bottoms (ATBs)" and therefore these terms can be used interchangeably.

The atmospheric tower bottoms (ATBs) are mixtures of heavy fractions of crude oil that flow out from the bottom of atmospheric distillation columns, e.g., atmospheric distillation columns. ATBs may contain at least a portion of kerosene/diesel fuel ($C_8$-$C_{18}$), at least a portion of jet fuel ($C_8$-$C_{16}$), at least a portion of fuel oil ($C_{20+}$), at least a portion of wax and other lubricating oils ($C_{20+}$), at least a portion of coke ($C_{50+}$), and a substantial amount of high molecular weight polyaromatic structures such as asphaltene and other complex hydrocarbon resins in a range of $C_5$-$C_{100+}$, preferably $C_{15}$-$C_{60}$, and more preferably $C_{25}$-$C_{45}$. These high molecular weight polyaromatic structures have boiling points in the range of 100-700° C., preferably 250-650° C., and more preferably 400-550° C.

In one embodiment, the atmospheric tower bottoms 111 may be divided into at least two substantially similar streams: 1) a first portion of the atmospheric tower bottoms 111, 2) a second portion of the atmospheric tower bottoms 111, using a liquid flow splitter (e.g. a three-way valve) which is located upstream of the integrated process and downstream of the atmospheric distillation column 101.

The heavy cracker residue is a mixture of heavy hydrocarbons that flow out from cracking units (i.e. fluid catalytic cracking, steam cracking, and/or hydrocracking unit). Composition of the heavy cracker residue is varied depending on the chemical reactions in the cracking units. In one embodiment, the heavy cracker residue may contain a substantial amount of high molecular weight polyaromatic structures such as asphaltene and other complex hydrocarbon resins in a range of $C_{30}$-$C_{100+}$, preferably $C_{30}$-$C_{50}$. In one embodiment, the heavy cracker residue may also contain a substantial amount of solid impurity (i.e. particulates) such as catalyst fines, micro-carbons (i.e. carbonaceous residue formed after pyrolysis of hydrocarbons), and/or coke particles.

Hydrotreating refers to a refining process whereby a feed stream is reacted with hydrogen gas in the presence of a catalyst to remove impurities such as sulfur, nitrogen, oxygen, and/or metals (e.g. nickel, or vanadium) from the feed stream (e.g. the atmospheric tower bottoms) through reductive processes. Hydrotreating processes may vary substantially depending on the type of feed to a hydrotreater. For example, light feeds (e.g. naphtha) contain very little and few types of impurities, whereas heavy feeds (e.g. ATBs) typically possess many different heavy compounds present in a crude oil. Apart from having heavy compounds, impurities in heavy feeds are more complex and difficult to treat than those present in light feeds. Therefore, hydrotreating of light feeds is generally performed at lower reaction severity, whereas heavy feeds require higher reaction pressures and temperatures.

A hydrotreater refers to a reactor vessel wherein hydrotreating reactions are performed in the presence of a catalyst. Hydrotreaters may vary substantially depending on the type of feed, for example a naphtha-hydrotreater is a hydrotreater with light feeds as feedstock, whereas a residue-hydrotreater is a hydrotreater with heavy feeds as feedstock. The hydrotreating reactions can be classified in two types: 1) Hydrogenolysis, where a carbon-heteroatom single bond is cleaved in the presence of hydrogen and catalyst. 2) Hydrogenation, where hydrogen is added to the cleaved molecules. The heteroatom can be any atom other than hydrogen or carbon, e.g. sulfur, nitrogen, oxygen, and/or metals.

In one embodiment, the first hydrotreater 102 in the integrated process may be a residue-hydrotreater, wherein the atmospheric tower bottoms 111 are hydrotreated and impurities such as sulfur, metals, and/or micro-carbons (i.e. carbonaceous residue formed after pyrolysis of hydrocarbons) are reduced. Accordingly, concentration of sulfur in the first hydrotreated residue stream 202 may reduce to at most 5,000 ppm, or at most 3,000 ppm, concentration of metals in the first hydrotreated residue stream 202 may reduce to at most 10 ppm, or at most 3 ppm, and concentration of micro-carbons in the first hydrotreated residue stream 202 may reduce to at most 50,000 ppm, or at most 40,000 ppm. Lighter compounds such as naphtha and/or diesel may be produced in the first hydrotreater. A light hydrotreated stream 201 may be separated and delivered to an aromatic saturation unit and/or a steam cracking unit depending on composition of the light hydrotreated stream 201.

The integrated process involves catalytically cracking the first hydrotreated residue stream in a fluid catalytic cracking unit 103 to form a liquefied petroleum gas (LPG) stream 113, a dry gas stream 131, a naphtha stream 114, a clarified slurry oil (CSO) stream 116 and a light cycle oil (LCO) stream 115.

Catalytically cracking refers to a refining process whereby long chain hydrocarbon molecules break into shorter molecules in the presence of a catalyst at relatively high temperature, preferably above 500° C., and moderate pressures, e.g., about 1.7 barg. Catalytic cracking units may vary depending on desired products. For example, fluid catalytic cracking is used where demand for diesel is higher, whereas hydrocracking units are more common where lighter products such as gasoline and kerosene are desired. Fluid catalytic cracking units are the type of catalytic cracking units where catalyst is a fluidized powder.

In one embodiment, the fluid catalytic cracking (FCC) unit 103 in the integrated process may be a residue fluid catalytic cracking unit which may be operated at high temperature, preferably 500-800° C., more preferably 500-750° C. and relatively high pressure, preferably 1.0-4 barg, more preferably 1.0-2.5 barg to maximize production of propylene in the liquefied petroleum gas stream 113.

In one embodiment, the catalytic cracking process produces the liquefied petroleum gas (LPG) stream 113. The liquefied petroleum gas (LPG) stream contains one or more of $C_1$-$C_4$, preferably $C_3$-$C_4$ paraffin and/or olefin compounds such as ethylene, propylene, n-propane, butylene, n-butane, i-butane, with a boiling point in the range of −165-50° C., preferably −40-30° C. The liquefied petroleum gas may be used as cooking gas and heating fuel. In one embodiment, at least a portion of the liquefied petroleum gas stream that involves propylene and/or i-butane may be used in alkylation processes for production of gasoline.

In one embodiment, the catalytic cracking process also produces dry gas. The dry gas stream 131 comprises methane, ethane, and hydrogen. In one embodiment, methane and/or ethane may be used as fuel within refinery and/or petrochemical processes.

In one embodiment, the dry gas may contain hydrogen gas and the process further involves separating the hydrogen gas from methane and ethane, and using it in the first hydrotreater 102, the second hydrotreater 104, or both.

In one embodiment, the catalytic cracking process generates naphtha stream 114. The naphtha stream 114 may contain at least 50%, or at least 60%, or at least 70%, or at least 80%, or at least 90%, or at least 95%, or at least 99% by weight of gasoline in the range of $C_1$-$C_{15}$, preferably $C_5$-$C_{10}$, and more preferably $C_7$-$C_8$, with a boiling point in the range of 100-220° C., preferably 100-140° C., and more preferably about 125° C. Depending on the type of hydrocarbons present in the naphtha stream 114, and also the amount of gasoline in the naphtha stream 114, it may be delivered to a naphtha hydrotreating process for further purification, and/or a catalytic reforming process to increase the gasoline octane number.

In one embodiment, the catalytic cracking process also generates the light cycle oil stream 115. The light cycle oil stream 115 may contain one or more of aliphatic, cycloaliphatic, and/or aromatic hydrocarbon compounds in the range of $C_1$-$C_{15+}$, preferably $C_5$-$C_{25}$, with a boiling point in the range of 50-400° C., preferably 100-380° C. The light cycle oil stream may be cracked to form paraffin and olefin compounds, or it may be saturated to form a stream of aliphatic and/or cycloaliphatic hydrocarbon compounds.

In one embodiment, a bottom product formed from the fluid catalytic cracking unit 103 is the clarified slurry oil (CSO) stream 116 that may be rich in heavy aromatic compounds in the range of $C_{30}$-$C_{100+}$, preferably $C_{50}$-$C_{80}$ that have a boiling point in the range of 200-600+° C., preferably 300-600° C. The clarified slurry oil stream may contain solid impurities (i.e. particulates) such as catalyst fines and/or coke particulates. This low value product may be partially oxidized or coked to produce light hydrocarbon compounds that may be further processed into useful products.

The integrated process involves hydrotreating the naphtha stream 114 in a second hydrotreater 104 to form a hydrotreated naphtha stream 117. The second hydrotreater 104, which may be a naphtha hydrotreater, reduces impurities such as sulfur, metals, and/or micro-carbons present in the naphtha stream 114 to form the hydrotreated naphtha stream 117 that has an impurity content of at most 50 ppm, or at most 40 ppm, or at most 30 ppm, or at most 20 ppm, or at most 10 ppm, or at most 5 ppm. The hydrotreated naphtha stream 117 may have higher gasoline and light gas oil than the naphtha stream 114. Accordingly, the hydrotreated naphtha stream 117 may contain at least 70%, or at least 80%, or at least 90%, or at least 95%, or at least 99% by weight of gasoline in the range of $C_1$-$C_{15}$, preferably $C_5$-$C_{15}$, and more preferably $C_5$-$C_{12}$ In one embodiment, the hydrotreated naphtha stream 117 may be delivered to a catalytic reforming unit to increase the octane number for gasoline production.

The integrated process involves hydrocracking the light cycle oil stream 115 in a hydrocracker 105 to form a cracked hydrocarbon stream 118.

Hydrocracking refers to a process whereby hydrocarbon molecules break into shorter molecules in the presence of a catalyst and hydrogen in a reactor vessel known as "hydrocracker". Similar to fluid catalytic cracking, hydrocracking is a carbon-carbon bond-breaking reaction which produces shorter chain hydrocarbon compounds. Despite similarities with fluid catalytic cracking processes, hydrocracking processes may be generally used for manufacturing gasoline and kerosene.

In one embodiment, the cracked hydrocarbon stream 118 comprises one or more of $C_1$-$C_{15}$, preferably $C_4$-$C_{12}$, and more preferably $C_5$-$C_{12}$ paraffin and/or olefin hydrocarbon compounds.

In one embodiment, the light cycle oil stream 115 may be hydrotreated and may be further saturated in a diesel hydrotreater prior to the hydrocracking.

The integrated process involves blending the hydrotreated naphtha stream 117 and the cracked hydrocarbon stream 118 to form an aromatic blended hydrocarbon stream 119.

In one embodiment, the hydrotreated naphtha stream 117 and the cracked hydrocarbon stream 118 are blended in a mixer to form the aromatic blended hydrocarbon stream 119 that contains aromatic compounds. In one embodiment, the aromatic blended hydrocarbon stream 119 comprises one or more of a paraffin and/or olefin phase, and one or more of an aromatic and/or cycloaliphatic phase hydrocarbon content in the range of $C_1$-$C_{15+}$, preferably $C_5$-$C_{12}$, with high concentration of aromatic compounds such as benzene, toluene, ethyl benzene, xylene and so forth. The aromatic compounds may be present in both streams (i.e. the hydrotreated naphtha stream 117 and the cracked hydrocarbon stream 118).

The integrated process involves saturating the aromatic blended hydrocarbon stream 119 in an aromatic saturating unit 106 to form a saturated hydrocarbon stream 120.

Aromatic saturation refers to a process whereby aromatic compounds are converted to cycloaliphatic compounds in presence of hydrogen gas in a pressurized reactor vessel referred to herein as an "aromatic saturating unit".

In one embodiment, the saturated hydrocarbon stream 120 may include one or more of $C_1$-$C_{15}$, preferably $C_3$-$C_{12}$, and more preferably $C_3$-$C_{12}$ paraffin and/or olefin hydrocarbon compounds, as well as light cycloaliphatic hydrocarbon compounds, and may contain less than 5%, preferably less than 1%, more preferably less than 0.5% by weight of aromatic hydrocarbon compounds.

The integrated process involves steam cracking the saturated hydrocarbon stream 120 in a steam cracking unit 107 to form a first olefin stream 203, a pyrolysis gasoline stream 125, and a pyrolysis oil stream 123.

Steam cracking refers to a refining process in which a hydrocarbon feedstock is diluted with steam and heated in the presence of steam to a cracking temperature to initiate a pyrolysis reaction in order to break carbon-carbon bonds, followed by a quick quenching to stop the pyrolysis reaction. The quenched hydrocarbon products include olefins, alkanes and/or aromatic/polyaromatics. Composition of product stream may depend on composition of feed, feed-to-steam flow ratio, cracking temperature, and/or residence time of hydrocarbons in steam cracking units. Each of these factors may be optimized to maximize production of a certain product (e.g. olefins). Steam cracking is a principal refining process for producing olefins (e.g. ethylene, propylene, and the like). Steam cracking reaction temperature may be in the range of 700-1,000° C., preferably 800-900° C., and even more preferably around 850° C.

In one embodiment, the first olefin stream 203 comprises one or more valuable light unsaturated olefin compounds such as ethylene, propylene, butylene, butadiene and so forth.

In one embodiment, the pyrolysis gasoline stream 125, or Pygas, is a mixture of olefins, paraffins, and aromatic hydrocarbon compounds ranging from $C_5$-$C_{15}$, preferably $C_5$-$C_{12}$ with a boiling point in the range of 40-220° C., more preferably 45-200° C. In one embodiment, the pyrolysis gasoline stream 125 may have at least 50%, or at least 60%, or at least 70%, or at least 80%, or at least 90% by weight of aromatic compounds and thus may be used as a gasoline blending mixture, and/or as a source of aromatic-rich feedstock for manufacturing other valuable organic compounds such as benzene, toluene, and/or xylene.

In one embodiment, the pyrolysis gasoline stream 125 may be recycled to the aromatic saturating unit 106.

In one embodiment, the pyrolysis oil stream 123, or Pyoil, or tar contains an asphaltene phase and/or a deasphalted phase, wherein the asphaltene phase has a substantial amount of high molecular weight polyaromatic structures such as asphaltene and other complex hydrocarbon resins in the range of $C_5$-$C_{100+}$, and more preferably $C_{15}$-$C_{60}$.

In one or more embodiments, the pyrolysis oil stream 123 may be used for production of asphalt, syngas, and/or fuel oil. In one embodiment, the pyrolysis oil stream 123 may be used as a feed to a coking unit to convert a portion of the high molecular weight polyaromatic structures into low molecular weight hydrocarbon compounds, and to use the low molecular weight hydrocarbon compounds as a feedstock for the steam cracking unit.

In one or more embodiments, the steam cracking process also produces hydrogen gas 122, and at least a portion of the hydrogen gas may be delivered to the first hydrotreater 102 (i.e. the residue hydrotreater), the second hydrotreater 104 (i.e. the naphtha hydrotreater), or both. The hydrogen gas may be delivered to other processes where hydrogen gas is needed.

The integrated process involves mixing the clarified slurry oil stream 116 and the pyrolysis oil stream 123 to form a recycle oil stream 124.

Pyrolysis oil streams and clarified slurry oil streams have conventionally been used as fuel oils. In the integrated process described herein, the use of atmospheric residue (i.e. atmospheric tower bottoms) as feedstock to the residue fluid catalytic cracking unit may produce a substantial amount of clarified slurry oil. The clarified slurry oil stream may contain solid impurities (i.e. particulates) such as catalyst fines and/or coke powders that may lead to fouling and clogging, and thus may be difficult for further processing. In addition, the use of a heavy feedstock to the steam cracking unit may lead to formation of a large amount of pyrolysis oil with a high asphaltene content. High asphaltene concentration may cause the pyrolysis oil stream to be relatively viscous and less miscible with other fuel oil streams and thus the pyrolysis oil stream may be more difficult for disposal. However, both the pyrolysis oil stream and the clarified slurry oil streams may contain at least a portion of light hydrocarbon compounds in the range of $C_{10}$-$C_{20}$. In the absence of further processing, neither the pyrolysis oil stream nor the clarified slurry oil stream may be delivered to a downstream operation unit such as a hydrotreater, because both the pyrolysis oil stream 123 and the clarified slurry oil stream 116 may result in rapid coking and plugging. In addition, asphaltene contents in the pyrolysis oil stream 123 may contaminate and deactivate catalysts and reduce catalysts life cycle.

In one embodiment, the pyrolysis oil stream 123 and the clarified slurry oil stream 116 are mixed in a mixer prior to any further processing to form the recycle oil stream 124. The pyrolysis oil stream 123 and the clarified slurry oil stream 116 may form a homogenous mixture because both streams contain a substantial amount of aromatic compounds.

In one embodiment, the clarified slurry oil stream may contain solid impurities (i.e. coke and catalyst particulates), and the solid impurities may be removed from the clarified slurry oil stream 116 by sieving, filtering, centrifugal acceleration, and/or sedimentation before mixing with the pyrolysis oil stream 123.

In one embodiment, the pyrolysis oil stream 123 and the clarified slurry oil stream 116 are mixed at different flow ratios. In one embodiment, the flow ratio of the pyrolysis oil stream 123 to the clarified slurry oil 116 is 0.1:0.9, or 0.2:0.8, or 0.3:0.7, or 0.4:0.6, or 0.5:0.5, or 0.6:0.4, or 0.7:0.3, or 0.8:0.2, or 0.9:0.1.

In one embodiment, the clarified slurry oil stream 116 and the pyrolysis oil stream 123 are mixed in the presence of a miscible organic solvent. In one embodiment, the organic solvent may be benzene, toluene, xylene, and/or ethylbenzene to be compatible with both the clarified slurry oil stream 116 and the pyrolysis oil stream 123. In one embodiment, the presence of the organic solvent reduces viscosity and facilitates transferring the recycle oil stream 124.

In one embodiment, the solid impurities may be removed from the recycle oil stream 124 by sieving, filtering, centrifugal acceleration, and/or sedimentation.

In one embodiment, the solid impurities may be removed from both the clarified slurry oil stream 116 and the recycle oil stream 124 by sieving, filtering, centrifugal acceleration, and/or sedimentation.

The integrated process involves deasphalting the recycle oil stream 124 in a solvent deasphalting unit 108 to form a deasphalted oil stream (DAO) 127 and an asphaltene rich stream (ARS) 128.

Deasphalting refers to a process for extracting asphaltene and high molecular weight resins from atmospheric residue (i.e. atmospheric tower bottoms), vacuum residue (i.e. atmospheric tower bottoms), and/or heavy vacuum gas oil to produce a valuable deasphalted oil that otherwise may not be recovered from heavy residue by conventional separation operations such as distillation.

In one embodiment, the deasphalting may include contacting the recycle oil stream 124, as a feedstock, with an organic solvent in the solvent deasphalting unit 108 under controlled temperatures and pressures. In one embodiment, temperature in the solvent deasphalting unit depends on the organic solvent. Therefore, temperature may be in the range of −20-300° C., preferably 20-120° C., more preferably 40-80° C., whereas pressure may be in the range of 1-40 barg, preferably 2-25 barg. In one embodiment, paraffinic and olefinic compounds that are soluble in the organic solvent may be extracted and collected as the deasphalted oil stream 127, leaving behind the asphaltene rich stream 128, which is rich in asphaltene and other resins that are insoluble in the organic solvent. In one embodiment, the organic solvent may be propane, n-butane, n-pentane, n-hexane, n-heptane and so forth.

In one embodiment, the solvent-to-feed flow ratio in the solvent deasphalting unit 108 may be adjusted to increase paraffin and olefin content in the deasphalted oil stream 127 and to reduce asphaltene content in the deasphalted oil stream 127. The solvent-to-feed flow ratio in the solvent deasphalting unit 108 may be in the range of 1:10, preferably 3:8, or even more preferably 5:8.

In one embodiment, the integrated process further involves collecting at least a portion of the asphaltene rich stream 128 for processing into asphalt.

In one embodiment, the asphaltene rich stream 128 may be delivered to a coking unit to form low molecular weight hydrocarbon compounds such as coker naphtha and/or coker gasoil.

In one embodiment, the recycle oil stream 124 may be combined with the second portion of the atmospheric tower bottoms 111 to form a combined heavy hydrocarbon stream 126 prior to the deasphalting. In one embodiment, the atmospheric tower bottoms 111 and the recycle oil stream 124 may be mixed at different flow ratios to form the combined heavy hydrocarbon stream 126. In one embodiment, the recycle oil stream 124 to the atmospheric tower bottoms 111 flow ratio may be 0.1:0.9, or 0.2:0.8, or 0.3:0.7, or 0.4:0.6, or 0.5:0.5, or 0.6:0.4, or 0.7:0.3, or 0.8:0.2, or 0.9:0.1 to provide a suitable feedstock for processing into the solvent deasphalting unit.

The integrated process involves hydrotreating a combined stream of the deasphalted oil stream 127 and the atmospheric tower bottoms 111 with the first hydrotreater 102 (i.e. the residue hydrotreater) to form a second hydrotreated residue stream 112.

In one embodiment, the organic solvent present in the deasphalted oil stream 127 may be removed through an extraction process using a super-critical extraction unit, a liquid-liquid extraction unit and/or an evaporation unit prior to combining with the atmospheric tower bottoms.

In one embodiment, the organic solvent present in the combined stream of the deasphalted oil stream 127 and the atmospheric tower bottoms 111 may be removed through an extraction process using a super-critical extraction unit, a liquid-liquid extraction unit and/or an evaporation unit prior to hydrotreating in the first hydrotreater.

In one embodiment, temperature of the deasphalted oil stream 127 is raised to a temperature above boiling point of the organic solvent in an evaporation unit, wherein the deasphalted oil stream 127 is held isothermally under this conditions for a sufficient time until final solvent content in the deasphalted oil stream 127 reduces to less than 1% by weight, preferably less than 0.5% by weight, and more preferably less than 0.1% by weight.

In one embodiment, the organic solvent present in the deasphalted oil stream 127 may be removed through an extraction process using a supercritical extraction unit, wherein a supercritical fluid (e.g. carbon dioxide ($CO_2$)) as an extracting solvent is raised above its critical temperature ($T_c$) and critical pressure ($P_c$). By manipulating temperature and pressure of the supercritical fluid, one can solubilize the organic solvent. Accordingly, the deasphalted oil stream 127 is pressurized with supercritical $CO_2$ in an extraction vessel wherein the supercritical $CO_2$ dissolves the organic solvent present in the deasphalted oil stream 127. The extracting solvent (i.e. supercritical $CO_2$) is further transferred to a collecting vessel wherein it is depressurized. As a result, $CO_2$ loses its solvating power leading the organic solvent to form an immiscible phase.

The integrated process involves delivering the second hydrotreated residue stream 112 to the fluid catalytic cracking unit 103 and repeating the integrated process to form a second olefin stream 121.

In one embodiment, the integrated process further involves combining the first olefin stream 203 and the second olefin stream 121 to give a final olefin yield that is higher than a substantially similar process without mixing the clarified slurry oil stream 116 and the pyrolysis oil stream 123, deasphalting the recycle oil stream 124 and the atmospheric tower bottoms 111, hydrotreating the deasphalted oil stream 127 and the atmospheric tower bottoms 111, delivering the second hydrotreated residue stream 112 to the fluid catalytic cracking unit, and repeating the integrated process. For example, final olefin production for the integrated process is at least 5%, or at least 6%, or at least 7%, or at least 8%, or at least 9%, or at least 10%, or at least 11%, or at least 12%, or at least 13%, or at least 14%, or at least 15%, or at least 16%, or at least 17%, or at least 18%, or at least 19%, or at least 20%, or at least 25%, or at least 30%, or at least 35%, or at least 40% by weight higher than a substantially similar process without processing the heavy cracker residue.

In one embodiment, as much as 180 Tons/hour (T/h), or as much as 190 T/h, or as much as 200 T/h, or as much as 220 T/h, or as much as 250 T/h olefin is produced for the integrated process wherein the flow rate for the atmospheric tower bottoms 111 is as much as 300 T/h, or as much as 400 T/h, or as much as 500 T/h, or as much as 600 T/h, or as much as 700 T/h. However, as much as 100 Tons/hour (T/h), or as much as 110 T/h, or as much as 120 T/h, or as much as 130 T/h, or as much as 140 T/h, or as much as 150 T/h, or as much as 160 T/h, or as much as 170 T/h, or as much as 180 T/h, or as much as 190 T/h, or as much as 200 T/h olefin is produced for a process that doesn't recycle and use the heavy cracker residue wherein the flow rate for the atmospheric tower bottoms is as much as 300 T/h, or as much as 400 T/h, or as much as 500 T/h, or as much as 600 T/h, or as much as 700 T/h.

According to a second aspect, the present disclosure relates to an integrated process for increasing olefin production by recycling and processing heavy cracker residue, involving i) hydrotreating atmospheric tower bottoms with a first hydrotreater to form a first hydrotreated residue stream, ii) catalytically cracking the first hydrotreated residue stream in a fluid catalytic cracking unit to form a liquefied petroleum gas stream, a naphtha stream, a dry gas stream, a clarified slurry oil stream and a light cycle oil stream, iii) hydrotreating the naphtha stream in a second hydrotreater to form a hydrotreated naphtha stream, iv) hydrocracking the light cycle oil stream in a hydrocracker to form a cracked hydrocarbon stream, v) blending the hydrotreated naphtha stream and the cracked hydrocarbon stream to form an aromatic blended hydrocarbon stream, vi) saturating the aromatic blended hydrocarbon stream in an aromatic saturating unit to form a saturated hydrocarbon stream, vii) steam cracking the saturated hydrocarbon stream in a steam cracking unit to form a first olefin stream, a pyrolysis oil stream, and a pyrolysis gasoline stream, viii) mixing the clarified slurry oil stream and the pyrolysis oil stream to form a recycle oil stream, ix) deasphalting the recycle oil stream in a solvent deasphalting unit to form a deasphalted oil stream and an asphaltene rich stream, x) coking at least a portion of the asphaltene rich stream to form a light hydrocarbon stream, xi) steam cracking the light hydrocarbon stream to form a second olefin stream, xii) hydrotreating the deasphalted oil stream and the atmospheric tower bottoms with the first hydrotreater to form a second hydrotreated residue stream, xiii) delivering the second hydrotreated residue stream to the fluid catalytic cracking unit and repeating the integrated process to form a third olefin stream.

Coking as used herein refers to a thermal cracking process wherein a heavy hydrocarbon residue stream (e.g. the asphaltene rich stream, atmospheric tower bottoms, and/or vacuum tower bottoms) is converted into low molecular weight hydrocarbon gases such as naphtha ($C_5$-$C_{17}$), light and heavy gas oils ($C_{10}$-$C_{25}$), and coke ($C_{50+}$). The coking process is performed in a furnace that is also referred to as a "coker".

In one embodiment, the light hydrocarbon stream may contain naphtha ($C_5$-$C_{17}$) and/or gas oils ($C_{10}$-$C_{25}$) and thus it may be sent to the steam cracking unit for producing light olefins.

In one embodiment, the integrated process further involves combining the first olefin stream, the second olefin stream, and the third olefin stream to give a final olefin yield that is higher than a substantially similar process without mixing the clarified slurry oil stream and the pyrolysis oil stream, deasphalting the recycle oil stream and the atmospheric tower bottoms, coking the asphaltene rich stream, steam cracking the light hydrocarbon stream, hydrotreating the deasphalted oil stream and the atmospheric tower bottoms, delivering the second hydrotreated residue stream to the fluid catalytic cracking unit, and repeating the integrated process. For example, final olefin production for the integrated process is at least 5%, or at least 6%, or at least 7%, or at least 8%, or at least 9%, or at least 10%, or at least 11%, or at least 12%, or at least 13%, or at least 14%, or at least 15%, or at least 16%, or at least 17%, or at least 18%, or at least 19%, or at least 20%, or at least 25%, or at least 30%, or at least 35%, or at least 40% by weight higher than a substantially similar process without processing the coking and without steam cracking the light hydrocarbon stream.

In one embodiment, the recycle oil stream may be mixed with the atmospheric tower bottoms prior to the deasphalting. In one embodiment, the atmospheric tower bottoms and the recycle oil stream may be mixed at different flow ratios. In one embodiment, the recycle oil stream to the atmospheric tower bottoms flow ratio may be 0.1:0.9, or 0.2:0.8, or 0.3:0.7, or 0.4:0.6, or 0.5:0.5, or 0.6:0.4, or 0.7:0.3, or 0.8:0.2, or 0.9:0.1 to provide a suitable feedstock for processing into the solvent deasphalting unit.

In one embodiment, the clarified slurry oil stream may contain solid impurities (i.e. particulates), and the solid impurities may be removed by sieving, filtering, centrifugal acceleration, and/or sedimentation from the clarified slurry oil stream, the recycle oil stream, or both.

According to a third aspect, the present disclosure relates to an integrated process for increasing olefin production by recycling and processing heavy cracker residue, involving i) hydrotreating atmospheric tower bottoms with a first hydrotreater to form a first hydrotreated residue stream, ii) catalytically cracking the first hydrotreated residue stream in a fluid catalytic cracking unit to form a liquefied petroleum gas stream, a naphtha stream, a dry gas stream, a clarified slurry oil stream and a light cycle oil stream, iii) hydrotreating the naphtha stream in a second hydrotreater to form a hydrotreated naphtha stream, iv) hydrocracking the light cycle oil stream in a hydrocracker to form a cracked hydrocarbon stream, v) blending the hydrotreated naphtha stream and the cracked hydrocarbon stream to form an aromatic blended hydrocarbon stream, vi) saturating the aromatic blended hydrocarbon stream in an aromatic saturating unit to form a saturated hydrocarbon stream, vii) steam cracking the saturated hydrocarbon stream in a steam cracking unit to form a first olefin stream, a pyrolysis oil stream, and a pyrolysis gasoline stream, viii) mixing the clarified slurry oil stream and the pyrolysis oil stream to form a recycle oil stream, ix) deasphalting the recycle oil stream in a solvent deasphalting unit to form a deasphalted oil stream and an asphaltene rich stream, x) partially oxidizing at least a portion of the asphaltene rich stream in an oxidizing unit 109 to produce a synthesis gas stream 129, xi) hydrotreating the deasphalted oil stream and the atmospheric tower bottoms with the first hydrotreater to form a second hydrotreated residue stream, xii) delivering the second hydrotreated residue stream to the fluid catalytic cracking unit and repeating the integrated process to form a second olefin stream.

Partial oxidation refers to a chemical reaction wherein a sub-stoichiometric fuel-air mixture (fuel and air are mixed in an off-stoichiometric flow ratio) is partially combusted in a reformer creating a synthesis gas stream, which contains one or more of hydrogen, carbon monoxide, and/or carbon dioxide.

In one embodiment, the synthesis gas stream 129 may contain hydrogen gas and the process further involves separating at least a portion of the hydrogen gas from the synthesis gas stream 129 and delivering the hydrogen gas stream 130 to the first hydrotreater 102, the second hydrotreater 104, or both. (The pathway to the second hydrotreater 104 is not shown in FIG. 1. In addition, the hydrogen gas stream 130 collected from the oxidizing unit (i.e. the synthesis gas stream) is substantially the same as the hydrogen gas stream 122 collected from the steam cracking unit, and the numerals only designates the differing origins (one from an oxidizing unit and one from a steam cracking unit)

In one embodiment, a portion of the synthesis gas stream 129 may be used to manufacture one or more oxo-aldehydes and/or oxo-alcohols in an oxo-process.

Oxo-process refers to a process wherein carbon monoxide and hydrogen react in the presence of an olefinic substrate to form isomeric aldehydes, or oxo-aldehydes. Oxo aldehyde products range from $C_3$ to $C_{15}$ and may be used as intermediates to produce oxo-products (e.g. oxo-alcohols) by the use of appropriate chemistry.

Oxo-alcohols are formed by hydrogenating oxo-aldehydes. Butanol, 2-ethyl hexanol, 2-Methyl-2-butanol, Isononyl alcohol, and Isodecyl alcohol are examples of oxo-alcohols. They may generally be used as plasticizers, and/or as intermediates to produce acrylic esters, formulate lubricants, and/or diesel additives.

The examples below are intended to further illustrate the substantial benefits of the present invention for increasing olefin production by recycling and processing heavy cracker residue, and are not intended to limit the scope of the claims.

Example 1

Referring now to FIG. 2. The following example case is intended to show some of the benefits of the present invention, without representing a limiting example. FIG. 2 is a block flow diagram (BFD) that shows the processing steps to produce a feedstock for the steam cracker from the atmospheric tower bottoms (ATB) 111. The atmospheric tower bottoms from an atmospheric distillation tower are processed through a residue hydrotreater 102 to reduce micro-carbon, sulfur and metals. During this processing step, lighter material 201 such as naphtha and diesel are produced, and separated by conventional separation devices known to people skilled in the art, and further delivered to an additional aromatics saturation stage or directly to the steam cracking unit. The hydrotreated atmospheric tower bottoms 202 are processed in a residue fluid catalytic cracking unit 103 operating at high severity to maximize the production of propylene.

Example 2

Figure 3:
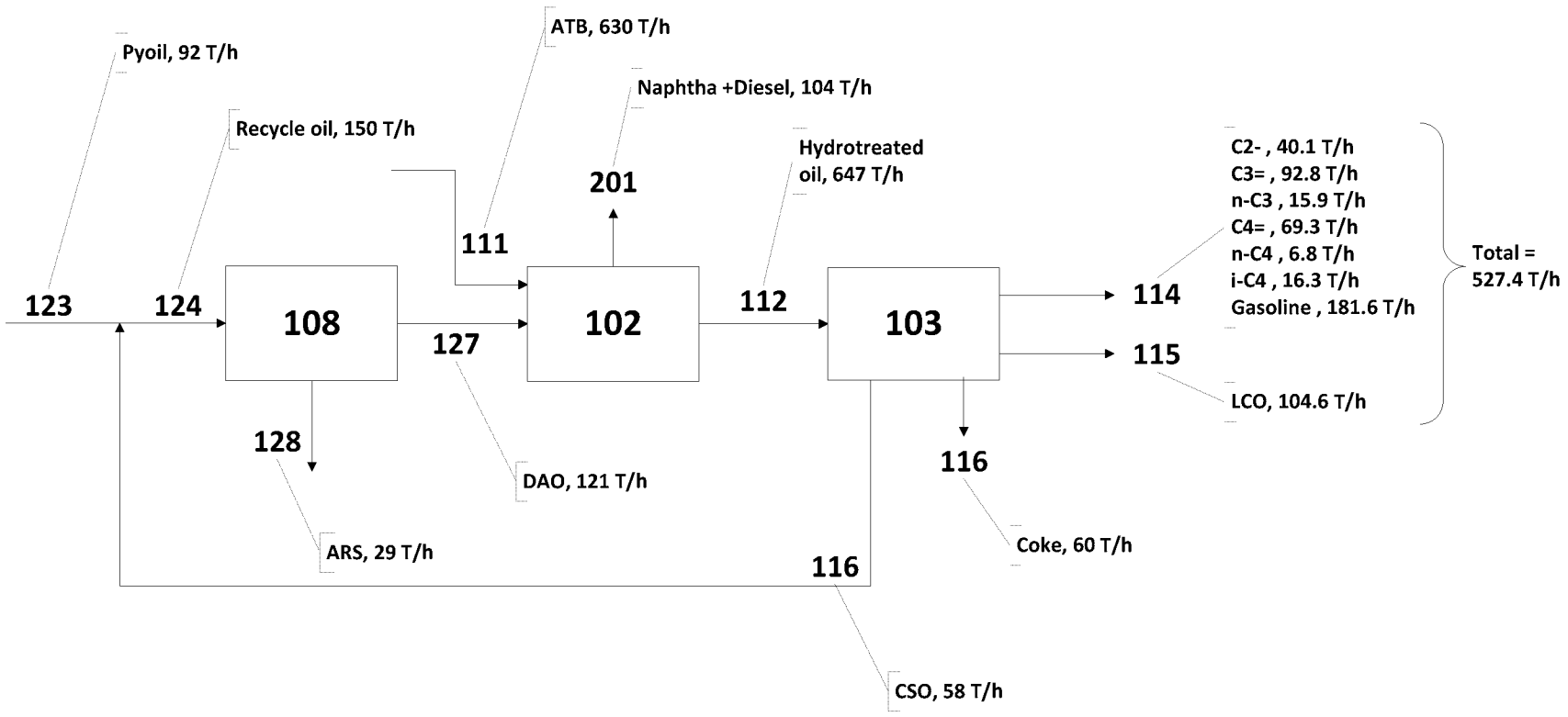
FIG. 3 is a Block Flow Diagram (BFD) that shows the processing of heavy cracker residue to produce a feedstock for the steam cracking unit to increase olefin production.

Referring now to FIG. 3. FIG. 3 is a block flow diagram that shows the benefit of the present invention related to the recycling and utilization of low value streams such as the Clarified Slurry Oil (CSO) 116 and the Pyoil 123 to produce a suitable feedstock for a steam cracker. Accordingly, a Clarified Slurry Oil stream 116 from the residue fluid catalytic unit 103 is recycled and combined with a Pyoil stream 123 coming from a steam cracker to be processed in a deasphalting unit 108. In the deasphalting unit, asphaltene is separated and delivered to a partial oxidation unit or to an asphalt production process, and the deasphalted oil stream (DAO) 127 is combined with the atmospheric tower bottoms 111 and processed in the hydrotreater to reduce micro-carbon, sulfur and metals. During this processing step, lighter material 201 such as naphtha and diesel are produced, and separated by conventional separation devices known to people skilled in the art, and further delivered to an additional aromatics saturation stage or directly to the steam cracking unit. The hydrotreated atmospheric tower bottoms 112 are processed in a residue fluid catalytic cracking unit 103 operating at high severity to maximize the production of propylene. It is clearly observed that there is about 16% increase of steam cracker suitable feedstock, which indicates the substantial benefits of the present invention.

The invention claimed is:

1. An integrated process for increasing olefin production from heavy cracker residues, comprising:

hydrotreating a heavy hydrocarbon residue stream with a first hydrotreater to form a first hydrotreated residue stream;

catalytically cracking the first hydrotreated residue stream in a fluid catalytic cracking unit to form a liquefied petroleum gas stream, a naphtha stream, a dry gas stream, a clarified slurry oil stream and a light cycle oil stream;

hydrotreating the naphtha stream in a second hydrotreater to form a hydrotreated naphtha stream;

hydrocracking the light cycle oil stream in a hydrocracker to form a cracked hydrocarbon stream;

mixing the hydrotreated naphtha stream and the cracked hydrocarbon stream to form an aromatic blended hydrocarbon stream;

saturating the aromatic blended hydrocarbon stream in an aromatic saturating unit to form a saturated hydrocarbon stream;

steam cracking the saturated hydrocarbon stream in a steam cracking unit to form a first olefin stream, a pyrolysis oil stream, and a pyrolysis gasoline stream;

mixing the clarified slurry oil stream and the pyrolysis oil stream to form a recycle oil stream;

deasphalting the recycle oil stream in a solvent deasphalting unit to form a deasphalted oil stream and an asphaltene rich stream;

hydrotreating the deasphalted oil stream and the heavy hydrocarbon residue stream with the first hydrotreater to form a second hydrotreated residue stream; and cracking the second hydrotreated residue stream to form a second olefin stream.

2. The process of claim 1, further comprising:

combining the first olefin stream and the second olefin stream to give a final olefin yield that is higher than a substantially similar process without the deasphalting, and without hydrotreating the deasphalted oil stream and the heavy hydrocarbon residue stream.

3. The process of claim 1, further comprising:

mixing the heavy hydrocarbon residue stream with the recycle oil stream prior to the deasphalting.

4. The process of claim 1, further comprising:

collecting at least a portion of the asphaltene rich stream for processing into asphalt.

5. The process of claim 1, wherein the steam cracking forms hydrogen gas in addition to the first olefin stream, the pyrolysis oil stream, and the pyrolysis gasoline stream.

6. The process of claim 5, further comprising:

delivering at least a portion of the hydrogen gas to the first hydrotreater, the second hydrotreater, or both.

7. The process of claim 1, wherein the light cycle oil stream is saturated prior to the hydrocracking.

8. The process of claim 1, wherein the light cycle oil stream is hydrotreated prior to the hydrocracking.

9. The process of claim 1, further comprising:

removing particulates from the clarified slurry oil stream, the recycle oil stream, or both.

10. The process of claim 1, wherein the clarified slurry oil stream and the pyrolysis oil stream are mixed in the presence of a miscible organic solvent.

11. The process of claim 1, wherein the fluid catalytic cracking unit is a residue fluid catalytic cracking unit.

12. An integrated process for increasing olefin production from heavy cracker residues, comprising:

hydrotreating a heavy hydrocarbon residue stream with a first hydrotreater to form a first hydrotreated residue stream;

catalytically cracking the first hydrotreated residue stream in a fluid catalytic cracking unit to form a liquefied petroleum gas stream, a naphtha stream, a dry gas stream, a clarified slurry oil stream and a light cycle oil stream;

hydrotreating the naphtha stream in a second hydrotreater to form a hydrotreated naphtha stream;

hydrocracking the light cycle oil stream in a hydrocracker to form a cracked hydrocarbon stream;

mixing the hydrotreated naphtha stream and the cracked hydrocarbon stream to form an aromatic blended hydrocarbon stream;

saturating the aromatic blended hydrocarbon stream in an aromatic saturating unit to form a saturated hydrocarbon stream;

steam cracking the saturated hydrocarbon stream in a steam cracking unit to form a first olefin stream, a pyrolysis oil stream, and a pyrolysis gasoline stream;

mixing the clarified slurry oil stream and the pyrolysis oil stream to form a recycle oil stream;

deasphalting the recycle oil stream in a solvent deasphalting unit to form a deasphalted oil stream and an asphaltene rich stream;

coking at least a portion of the asphaltene rich stream to form a light hydrocarbon stream;

steam cracking the light hydrocarbon stream to form a third olefin stream;

hydrotreating the deasphalted oil stream and the heavy hydrocarbon residue stream with the first hydrotreater to form a second hydrotreated residue stream; and cracking the second hydrotreated residue stream to form a second olefin stream.

13. The process of claim 12, further comprising:

combining the first olefin stream, the second olefin stream, and the third olefin stream to give a final olefin yield that is higher than a substantially similar process without the deasphalting, the coking, steam cracking the light hydrocarbon stream, and hydrotreating the deasphalted oil stream and the heavy hydrocarbon residue stream.

14. The process of claim 12, further comprising:

mixing the heavy hydrocarbon residue stream with the recycle oil stream prior to the deasphalting.

15. The process of claim 12, further comprising:

removing particulates from the clarified slurry oil stream, the recycle oil stream, or both.

16. An integrated process for increasing olefin production from heavy cracker residues, comprising:

hydrotreating a heavy hydrocarbon residue stream with a first hydrotreater to form a first hydrotreated residue stream;

catalytically cracking the first hydrotreated residue stream in a fluid catalytic cracking unit to form a liquefied petroleum gas stream, a naphtha stream, a dry gas stream, a clarified slurry oil stream and a light cycle oil stream;

hydrotreating the naphtha stream in a second hydrotreater to form a hydrotreated naphtha stream;

hydrocracking the light cycle oil stream in a hydrocracker to form a cracked hydrocarbon stream;

mixing the hydrotreated naphtha stream and the cracked hydrocarbon stream to form an aromatic blended hydrocarbon stream;

saturating the aromatic blended hydrocarbon stream in an aromatic saturating unit to form a saturated hydrocarbon stream;

steam cracking the saturated hydrocarbon stream in a steam cracking unit to form a first olefin stream, a pyrolysis oil stream, and a pyrolysis gasoline stream;

mixing the clarified slurry oil stream and the pyrolysis oil stream to form a recycle oil stream;

deasphalting the recycle oil stream in a solvent deasphalting unit to form a deasphalted oil stream and an asphaltene rich stream;

partially oxidizing at least a portion of the asphaltene rich stream to produce a synthesis gas stream;

hydrotreating the deasphalted oil stream and the heavy hydrocarbon residue stream with the first hydrotreater to form a second hydrotreated residue stream; and cracking the second hydrotreated residue stream to form a second olefin stream.

17. The process of claim 16, wherein the synthesis gas stream comprises hydrogen gas and the process further comprises separating at least a portion of the hydrogen gas from the synthesis gas stream and delivering it to the first hydrotreater, the second hydrotreater, or both.

18. The process of claim 16, further comprising:

delivering at least a portion of the synthesis gas stream to a processing unit for manufacturing oxo-aldehydes, or oxo-alcohols.

19. The process of claim 16, further comprising:

mixing the heavy hydrocarbon residue stream with the recycle oil stream prior to the deasphalting.

20. The process of claim 16, further comprising:
removing particulates from the clarified slurry oil stream, the recycle oil stream, or both.

* * * * *